US005598864A

United States Patent [19]

Johnston et al.

[11] Patent Number: 5,598,864

[45] Date of Patent: Feb. 4, 1997

[54] SUBSURFACE SAFETY VALVE

[75] Inventors: Russell A. Johnston, Alvin; David A. Bilberry, Houston, both of Tex.

[73] Assignee: Camco International Inc., Houston, Tex.

[21] Appl. No.: 326,017

[22] Filed: Oct. 19, 1994

[51] Int. Cl.[6] ..... E21B 34/14

[52] U.S. Cl. ..... 137/68.16; 251/14; 251/58; 251/368; 166/317; 166/332.8

[58] Field of Search ..... 166/317, 332.8; 251/14, 58, 368; 137/68.16

[56] References Cited

U.S. PATENT DOCUMENTS

| | | | |
|---|---|---|---|
| 3,188,048 | 6/1965 | Sutherland | 251/368 X |
| 3,786,865 | 1/1974 | Tausch et al. | 251/58 X |
| 3,786,866 | 1/1974 | Tausch et al. | 251/58 X |
| 3,799,258 | 3/1974 | Tausch | 137/494 |
| 4,154,303 | 5/1979 | Fournier | 166/317 |
| 4,221,307 | 9/1980 | Peterson | 251/368 X |
| 4,252,197 | 2/1981 | Pringle | 166/322 |
| 4,340,088 | 7/1982 | Geisow | 166/324 |
| 4,377,274 | 3/1983 | Mayhew | 251/368 X |
| 4,422,618 | 12/1983 | Lawson | 251/58 |
| 4,460,046 | 7/1984 | Pringle | 137/68.16 X |
| 4,860,991 | 8/1989 | Blizzard et al. | 251/62 |
| 4,926,945 | 5/1990 | Pringle et al. | 166/321 |
| 5,236,047 | 8/1993 | Pringle et al. | 166/369 |
| B1 4,161,219 | 2/1984 | Pringle | 166/324 |

FOREIGN PATENT DOCUMENTS

| | | |
|---|---|---|
| 0521667 | 1/1993 | European Pat. Off. . |
| 2186305 | 8/1987 | United Kingdom . |
| 2188962 | 10/1987 | United Kingdom . |
| 2272922 | 6/1994 | United Kingdom . |

*Primary Examiner*—John Rivell

[57] ABSTRACT

A subsurface safety valve has a tubular valve housing, a valve closure member movable between an open and a closed position, an axially shiftable flow tube for opening the valve closure member, a spring for biasing the flow tube to a closed position, a piston and cylinder assembly to move the flow tube to an open position, and a plug inserted within an opening in the valve housing. This opening is in fluid communication with the piston and cylinder assembly. The plug is adapted to be displaced from the opening to lock out the safety valve, and to establish secondary hydraulic fluid communication with an interior of the safety valve in order to operate secondary tools, such as wireline set secondary valves, inserted into the locked out safety valve.

15 Claims, 4 Drawing Sheets

Section B—B

View A—A

SUBSURFACE SAFETY VALVE

BACKGROUND OF THE INVENTION

1. Field of the Invention

The present invention relates to a subsurface safety valve and, more particularly, to a subsurface safety valve with a simple internal mechanism to provide secondary control fluid communication when the safety valve is locked out.

2. Description of Related Art

Subsurface safety valves are used within wellbores to prevent the uncontrolled escape of wellbore fluids, which if not controlled could directly lead to a catastrophic well blowout. Certain styles of safety valves are called flapper type valves because the valve closure member is in the form of a circular disc, as disclosed in U.S. Pat. No. 3,799,258, or in the form of a curved disc, as disclosed in U.S. Pat. No. 4,926,945. These flappers are opened by the application of hydraulic pressure to a piston and cylinder assembly, as is disclosed in U.S. Re. Pat. No. B14,161,219, to move a flow tube against the flapper. The flow tube is biased by a helical spring in a direction to allow the flapper to close in the event that hydraulic fluid pressure is reduced or lost.

Safety valves of the past have included relatively complicated and thereby expensive to manufacture mechanisms to lock out the safety valve. To "lock out" a safety valve is a term well known to those skilled in the art, and is defined as the ability to temporarily or permanently lock the safety valve's flapper in an open position. A safety valve is locked out when the safety valve fails, such as the seals have failed, or during well workover operations. Once a safety valve is locked out, a secondary or wireline retrievable inset valve is sealably set inside of the longitudinal bore of the safety valve, as described in U.S. Pat. No. 4,252,197, or within a hydraulic communication nipple, and the existing hydraulic control line is used to operate the inset valve.

Previous mechanisms to lock out a safety valve and establish the secondary hydraulic communication pathways added additional length to the safety valve and/or increased the mechanical complexity of the safety valve, thereby increasing the cost of the safety valve. There exists the need for a safety valve with a relatively simple and thereby less costly mechanism to lock out the safety valve.

SUMMARY OF THE INVENTION

The present invention has been contemplated to overcome the foregoing deficiencies and meet the above described needs. Specifically, the present invention is a subsurface safety valve which has a tubular valve housing, a valve closure member movable between an open and a closed position, an axially shiftable flow tube for opening the valve closure member, a spring for biasing the flow tube to a closed position, a piston and cylinder assembly to move the flow tube to an open position, and a plug inserted within an opening in the valve housing. This opening is in fluid communication with the piston and cylinder assembly. The plug is adapted to be displaced from the opening to lock out the safety valve, and to establish secondary hydraulic fluid communication with an interior of the safety valve in order to operate secondary tools, such as wireline set secondary valves, inserted into the locked out safety valve.

The safety valve includes an extremely simple and effective mechanism to lock out the safety valve and establish secondary hydraulic fluid. When such a secondary valve is to be set within the safety valve, a wireline impact tool forces the secondary sleeve to shear pins, which in turn causes the plug to be withdrawn from the opening. This design precludes reentry of the plug into the opening, therefore the secondary sleeve and the flow tube cannot be moved and so the flapper is locked in the open position. Since the plug is withdrawn from the opening, hydraulic fluid is permitted to flow into the internal longitudinal opening of the safety valve and into the operating mechanism of the secondary valve.

DETAILED DESCRIPTION OF THE PREFERRED EMBODIMENTS

As has been briefly described above, the present invention is a subsurface safety valve having a relatively simple and thereby less costly mechanism to lock out the safety valve as compared to prior safety valves. The safety valve of the present invention has a tubular valve housing, a valve closure member movable between an open and a closed position, an axially shiftable flow tube for opening the valve closure member, a spring for biasing the flow tube to a closed position, a piston and cylinder assembly to move the flow tube to an open position, and a plug inserted within an opening in the valve housing. This opening is in fluid communication with the piston and cylinder assembly. The plug is adapted to be displaced from the opening to lock out the safety valve, and to establish secondary hydraulic fluid communication with the interior of the safety valve in order to operate secondary tools, such as wireline set secondary valves, inserted into the locked out safety valve.

For the purposes of the present discussion the safety valve will be described as a rod piston safety valve of the type disclosed in U.S. Re. Pat. No. B14,161,219 and U.S. Pat. No. 4,860,991, which are commonly assigned hereto and which are incorporated herein by reference. However, it should be understood that all of the novel features of the present invention to be described in detail below can be beneficially used with other types of commercially available safety valves.

Figure 1:
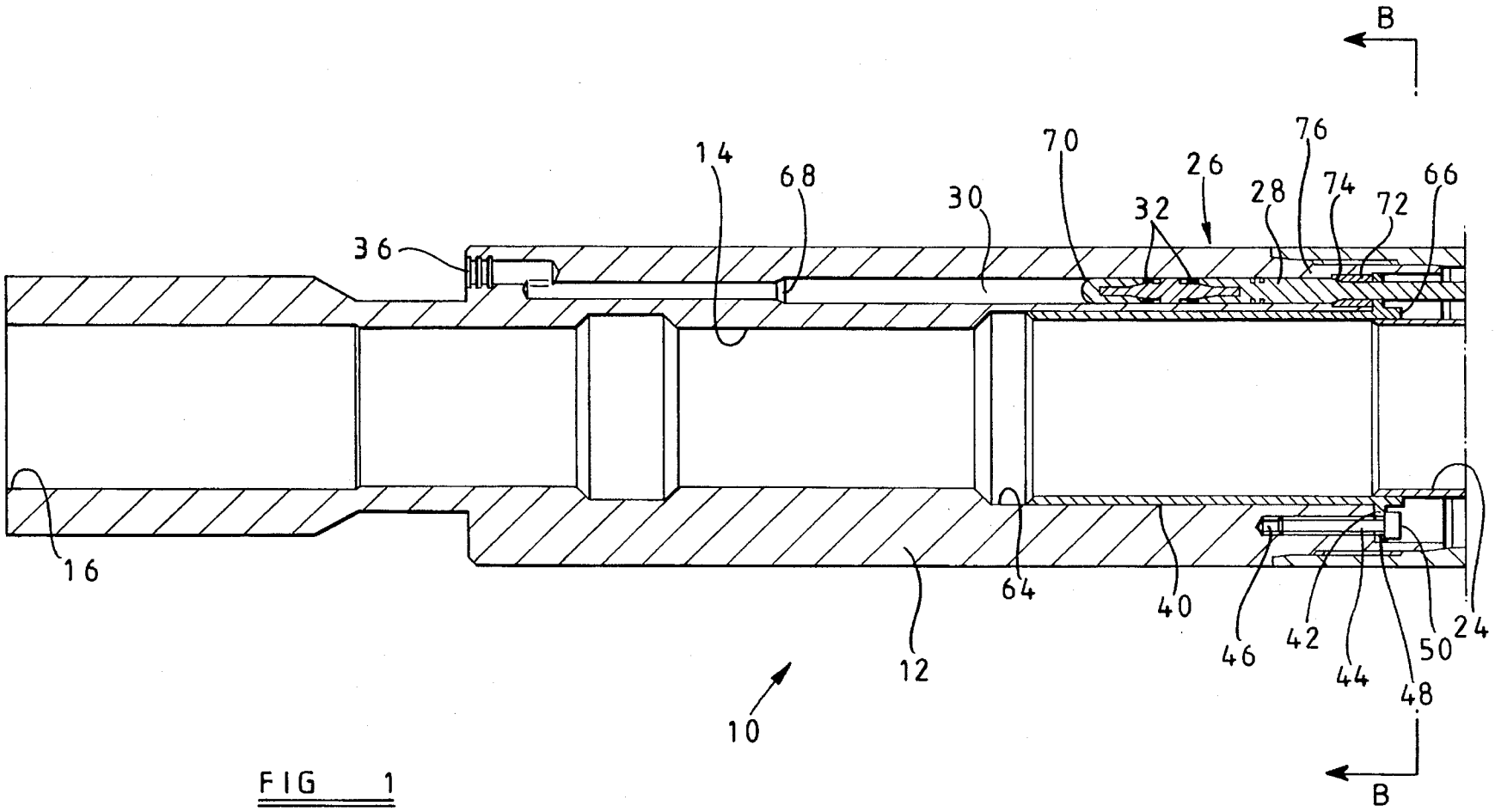
FIGS. 1, 2 and 3 taken together form a side elevational view in partial cross-section of one preferred embodiment of a subsurface safety valve of the present invention, with a flow tube therein shown in an extended or valve-open position.
Figure 2:
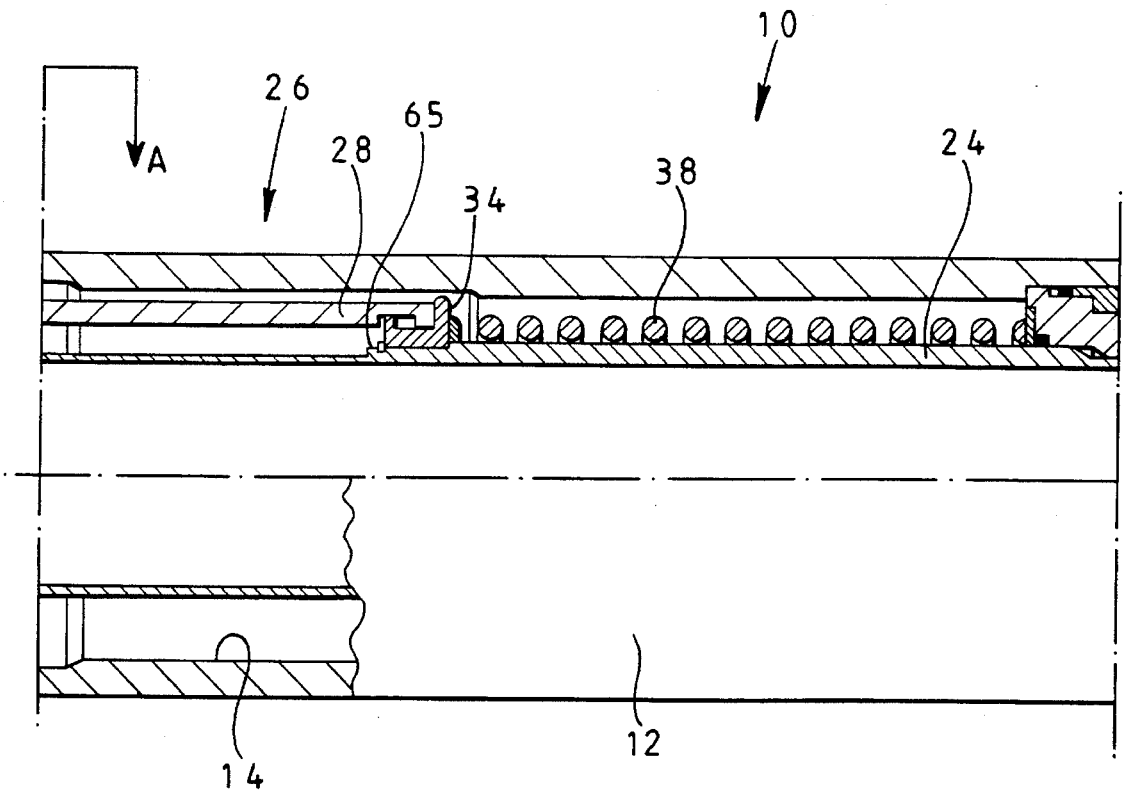
Figure 3:
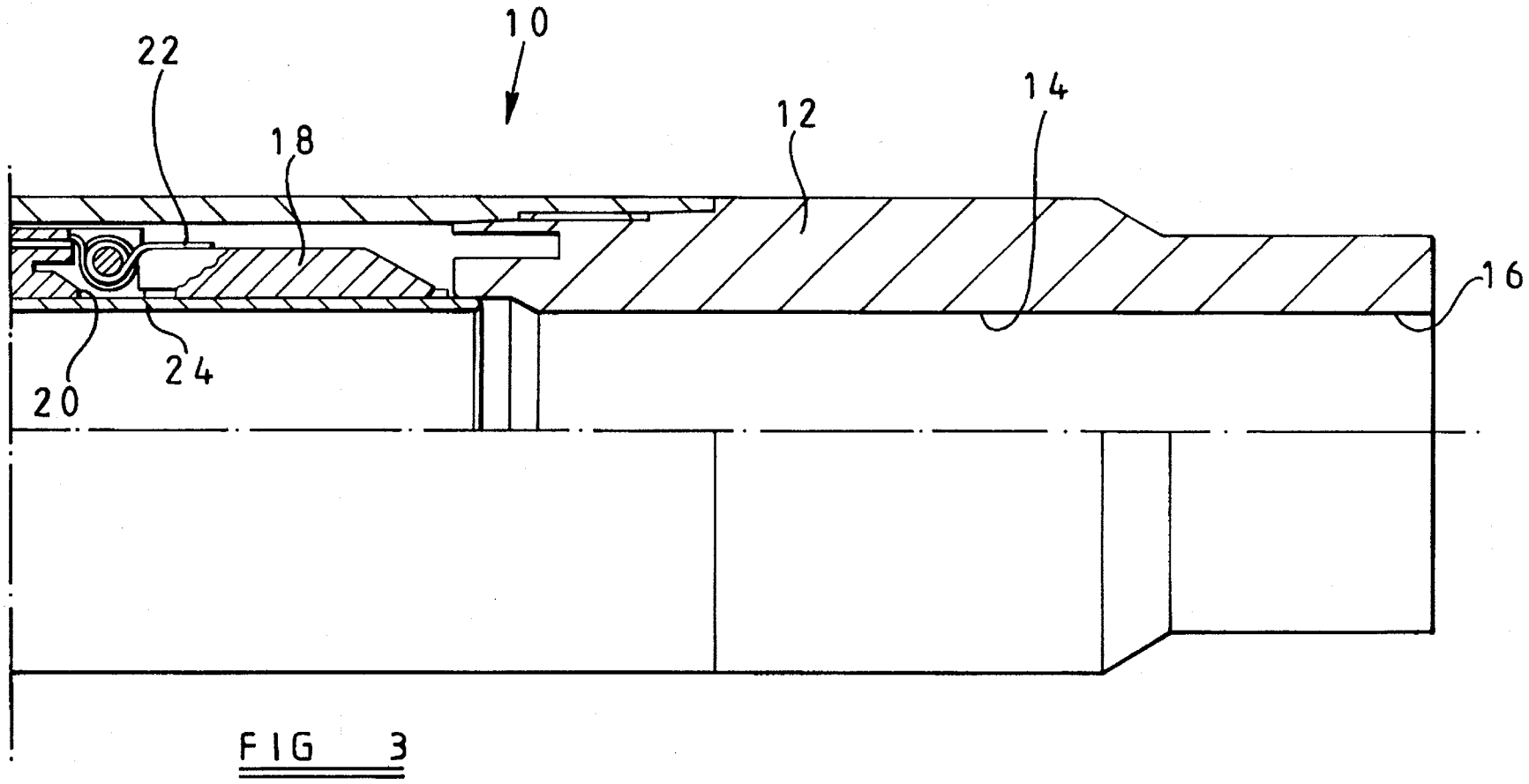

One preferred embodiment of the present invention is shown in FIGS. 1, 2 and 3 wherein a safety valve 10 comprises a generally cylindrical or tubular housing 12 with a longitudinal opening 14 extending therethrough. At each longitudinal end of the housing 12, connection mechanisms, such as threaded couplings 16, are provided for connecting the housing 12 to a pipe string (not shown), as is well known to those skilled in the art. Within the housing 12 is mounted a valve closure member 18, commonly referred to as a "flapper", which is hingedly mounted within an internal recess in the housing 12. The flapper 18 can be in the form of a generally flat disk or a curved disk. Further, any other type of valve closure mechanism can be used, such as a laterally moving plug, a rotating ball, and the like.

The purpose of the valve closure mechanism 18 is to close off and seal the opening 14 to prevent the flow of fluid therethrough. Accordingly, the valve closure member 18 is rotated into a "closed" position and held against annular valve seats 20 by action of a hinge spring 22, as is well known to those skilled in the art. The mechanism that acts upon the flapper 18 to push it into an "open" position, as shown in FIGS. 1, 2 and 3, is an axially shiftable flow tube 24. The flow tube 24 is forced against the flapper 18 by action of a piston and cylinder assembly 26, which is comprised of an elongated rod or piston 28 axially movable within a cylinder or bore 30 located either outside of or, preferably, within the wall of the housing 12. One or more annular seals 32 are provided on the piston 28 adjacent a first end thereof, and a second end of the piston 28 is pinned or otherwise connected to a ridge 34 on the flow tube 24. Hydraulic operating fluid is provided to the assembly 26 through a conduit 36, that extends to the earth's surface, to move the piston 28 and thereby to force the flow tube 24 against and to open the flapper 18, as is well known to those skilled in the art.

The flapper 18 and flow tube 24 will remain in the open position to permit the flow of fluids through the opening 14 as long as hydraulic pressure is maintained through the conduit 36 and against the piston 28. In the event that the seals 32 fail or if the conduit 36 is damaged, the loss of hydraulic fluid pressure will permit the flapper 18 to rotate to a closed position, in this manner the safety valve is considered a fail-safe design. However, the force of the hinge spring 22 on the flapper 18 is usually not sufficient to rotate the flapper 18 to a closed position and to axially move the flow tube 24 and the piston 28. In order to close the flapper 18, a relatively large helical power spring 38 is disposed coaxially with and on the outside of the flow tube 24, as shown in U.S. Pat. No. 4,860,991. Also, in place of the single power spring 38, a plurality of parallel helical springs can be radially disposed in the housing 12 around the periphery of the flow tube 24, as is disclosed in U.S. Pat. No. 4,340,088.

In the event that the wellbore below the safety valve 10 needs to be worked over, or if the safety valve 10 fails, there is a need to lock out the safety valve. The term to "lock out" a safety valve is a term well known to those skilled in the art, and is defined as the ability to temporarily or permanently lock the safety valve's flapper in an open position. The present invention is provided with a simplified mechanisms to lock out the safety valve. In one preferred embodiment of the safety valve 10 a secondary sleeve 40 is mounted within the longitudinal opening 14, with the secondary sleeve 40 having an internal diameter greater than the outside diameter of the flow tube 24. The secondary sleeve 40 is mounted coaxial with and partially surrounding a first end of the flow tube 24. The secondary sleeve 40 includes an annular ridge or flange 42 adjacent a second end thereof. The secondary sleeve 40 is prevented from moving by having one or more shearable pins or bolts 44 press fitted or threaded into bores 46 within the housing 12. Each bolt 44 passes through a hole 48 in the flange 42, with a head 50 of each bolt 44 extending across such hole 48.

Figure 4:
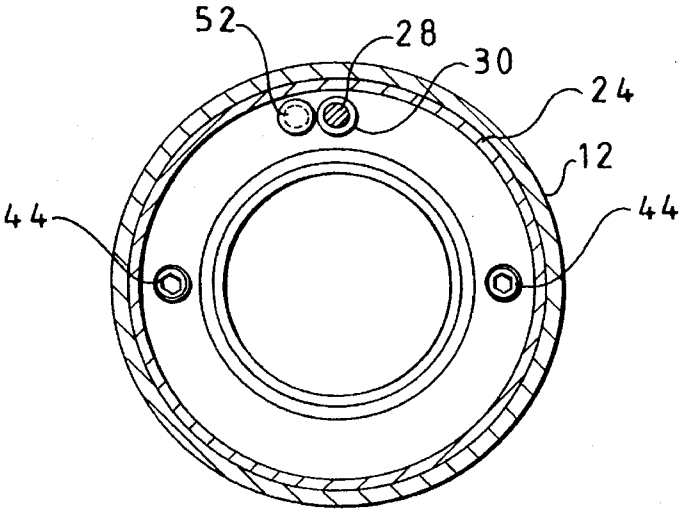
FIG. 4 is a view taken along line B—B of FIG. 1.
Figure 5:
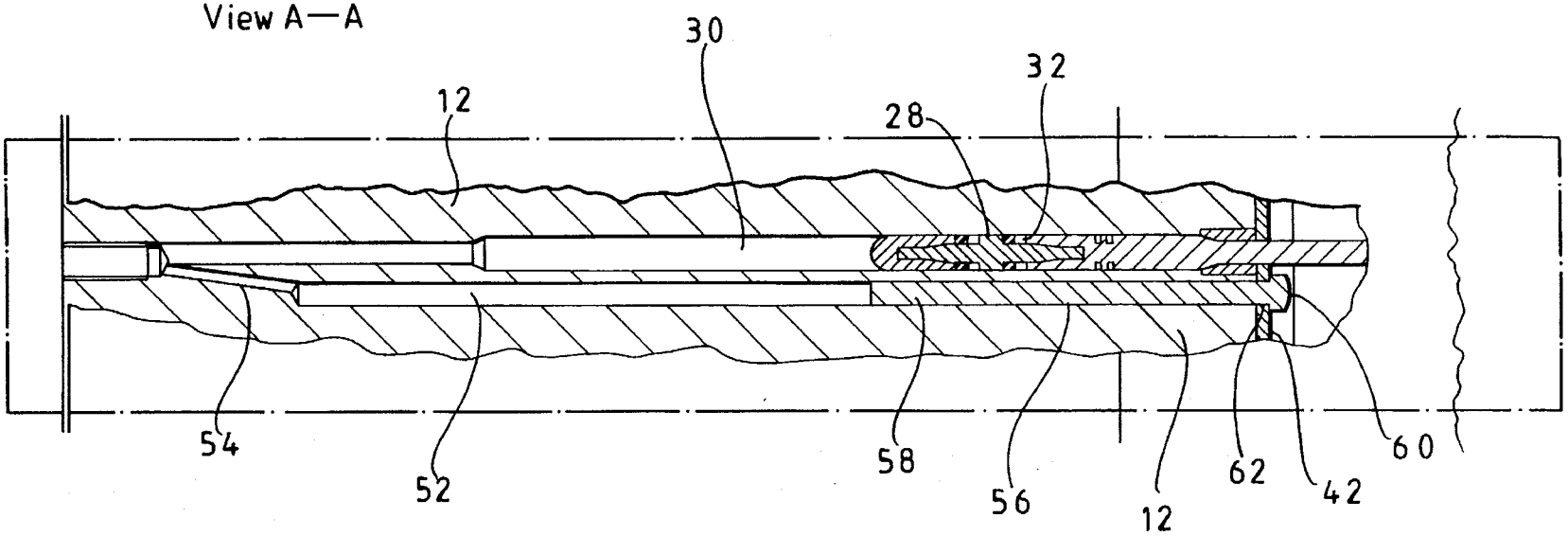
FIG. 5 is a view taken along line A—A of FIG. 1.

As shown in FIGS. 4 and 5, spaced adjacent to and parallel with the piston and cylinder assembly 26 is a secondary opening 52. A first end portion of the secondary opening 52 is provided with a side bore 54 to enable hydraulic fluid to pass from the cylinder 30 into the secondary opening 52. Threaded or press fitted into a second end portion of the secondary opening 52 is a plug 56 that prevents hydraulic fluid from exiting the secondary opening 52 until the plug 56 is removed, as will be described below. The plug 56 includes an elongated shaft 58 that is disposed within the secondary opening 52, and includes an enlarged head 60 that is fitted across a notch or hole 62 in the flange 42 of the secondary sleeve 40.

When the safety valve 10 is to be locked out, a wireline conveyed jar or shifting tool (not shown) is inserted into the longitudinal opening 14 of the safety valve housing 12 and landed within an annular recess or ridge 64 within the longitudinal opening 14. With the jar or shifting tool properly landed within the safety valve 10, it is operated to apply a force or impact upon the first end of the secondary sleeve 40 to force it longitudinally or "downwardly", and then therepast to shear the bolts 44. The secondary sleeve 40 will continue to axially move within the housing 12 until a second or "lower" end thereof contacts an annular shoulder 65 within the opening 14 or on the exterior surface of the flow tube 24. The flow tube 24 is then moved downwardly to open the flapper 18.

To lock out the safety valve 10, the lengths of the shaft 58 of the plug 56 and of the secondary opening 52 are selected so that when the secondary sleeve 40 is moved to shear the bolts 44, the first end of the shaft 58 will be withdrawn from the secondary opening 52. To prevent the shaft 58 from reentering the secondary opening 52, the hole 62 is sized so that the shaft 56 is loosely fitted therein and thereby the "upper" or first end of the shaft 56 will move out of coaxial alignment with the secondary opening 52. Alternatively, a leaf spring (not shown) can be mounted transversely to the longitudinal axis of the secondary opening 52. The spring forces the first end of the plug 56 out of coaxial alignment with the secondary opening 52. The plug 56 then becomes propped against a recess 66 within the longitudinal opening 14, and the flow tube cannot be moved "upwardly" by interaction of the recesses and flanges on the secondary sleeve 40 and the flow tube 24; therefore, the flapper 18 is locked in the open position to "lock out" the safety valve 10.

Once the plug 56 has been withdrawn form the secondary opening 52, hydraulic fluid can then freely pass through the conduit 36, the side bore 54, and through the unplugged secondary opening 52 and then into the longitudinal opening 14.

To assist in the reduction of cost of the safety valve 10, the piston and cylinder assembly 26 is provided with special seals made from non-metallic and non-elastomeric material(s). These seals are less expensive than all metal seals and are able to be operated within more severe wellbore environments than conventional elastomeric seals. As used herein, the term "non-metallic, non-elastomeric material" refers to material formed from polyetherketone (PEK), polyetheretherketone (PEEK), polyetherketoneetherketoneketone (PEKEKK), polyamides, polyethylene terephthalates (PET), polysulphones, epoxies, polyesters, polyethers, polyketones, and other polymerizable combinations thereof. For the purposes of the following discussion, the seal material will be assumed to be polyetheretherketone (PEEK).

In one preferred embodiment of the present invention the first end or "upper" end of the cylinder 30 includes an annular bevel or constriction 68 that functions as the upper piston stop. A first end of the piston 28 includes a rounded helmet 70 formed from the nonmetallic, non-elastomeric material. Additionally or alternatively, a second or "lower" portion of the cylinder 30 includes an insert 72 formed from the non-metallic, non-elastomeric material. The insert 72 includes a bore through which the shaft of the piston 28 extends, and includes an annular bevel 74 around this bore. A second end or "lower" end of the head of the piston 28 includes an annular beveled seal seat 76 that mates with the beveled insert 72.

Taken together, it should be understood by those skilled in the art that the safety valve of the present inventions includes numerous advances over the prior safety valves, including but not being limited to the ability to be looked out with a relatively uncomplicated and low cost internal mechanism, the ability to provide secondary fluid communication to a wireline set valve without the need for complicated and expensive internal mechanisms, and the ability to provide relatively low cost upper and lower seals for the piston and cylinder assembly 26 which can operate in relatively harsh wellbore environments without the need for relatively expensive all metal seals.

Whereas the present invention has been described in particular relation to the drawings attached hereto, it should be understood that other and further modifications, apart from those shown or suggested herein, may be made within the scope and spirit of the present invention.

What is claimed:

1. A subsurface safety valve comprising:

a tubular valve housing;

a valve closure member movable between an open and a closed position;

an axially shiftable flow tube for opening the valve closure member;

a spring for biasing the flow tube to a closed position;

a hydraulic control line to communicate fluid to move the flow tube to an open position; and a non-frangible plug inserted within an opening in the valve housing, the opening in fluid communication with the hydraulic control line, and the plug adapted to be withdrawn from the opening to open a fluid passage between the control line and a longitudinal opening extending through the valve housing, and biased out of alignment with the opening in the valve housing to prevent its reinsertion to lock out the safety valve.

2. A subsurface safety valve of claim 1 and further comprising a secondary sleeve concentric with and surrounding a portion of the flow tube, with the plug connected to the secondary sleeve so that when the secondary sleeve is shifted axially the plug is displaced from the opening.

3. A subsurface safety valve of claim 2 and further comprising at least one shearable pin for preventing the secondary sleeve from moving until sufficient force is exerted thereupon to shear the at least one pin.

4. A subsurface safety valve of claim 3 wherein the at least one shearable pin including a shank portion inserted into a bore in the housing, and having an enlarged head adapted to engage an extension on an edge portion of the secondary sleeve.

5. A subsurface safety valve of claim 4 wherein the plug includes a shank inserted into the opening in the housing and having an enlarged head adapted to engage an extension on an edge; portion of the secondary sleeve.

6. A subsurface safety valve of claim 1 wherein the opening is substantially parallel with and adjacent a piston and cylinder assembly within the valve housing.

7. A subsurface safety valve of claim 1 wherein a first end of the plug is configured to prevent the plug from reentering the opening once the first end of the plug has been withdrawn therefrom.

8. A subsurface safety valve of claim 1 wherein the plug is displaced laterally once the plug is withdrawn from the opening to thereby prevent the plug from reentering the opening and to thereby prevent the flow tube from moving to lock out the safety valve.

9. A subsurface safety valve comprising:

a tubular valve housing;

a valve closure member movable between an open and a closed position;

an axially shiftable flow tube for opening the valve closure member;

a spring for biasing the flow tube to a closed position;

a hydraulic control line to in fluid communication with a piston and cylinder assembly to move the flow tube to an open position;

a plug inserted within an opening in the valve housing, the opening in fluid communication with the hydraulic control line, and the plug adapted to be withdrawn from the opening to open a fluid passage between the control line and a longitudinal opening extending through the valve housing; and the piston includes a non-metallic, non-elastomeric first end portion adapted to seal against an annular metallic seat within a first end portion of the cylinder.

10. A subsurface safety valve of claim 9 wherein the piston and cylinder assembly includes at least one non-metallic, non-elastomeric seal.

11. A subsurface safety valve of claim 10 wherein the non-metallic, non-elastomeric seal is formed from material selected from the group consisting of polyetherketone (PEK), polyetheretherketone (PEEK), polyetherketoneetherketoneketone (PEKEKK), polyamides, polyethylene terephthalates (PET), polysulphones, epoxies, polyesters, polyethers, polyketones, and polymerizable combinations thereof.

12. A subsurface safety valve comprising:

a tubular valve housing;

a valve closure member movable between an open and a closed position;

an axially shiftable flow tube for opening the valve closure member;

a spring for biasing the flow tube to a closed position;

a hydraulic control line to in fluid communication with a piston and cylinder assembly to move the flow tube to an open position;

a plug inserted within an opening in the valve housing, the opening in fluid communication with the hydraulic control line, and the plug adapted to be withdrawn from the opening to open a fluid passage between the control line and a longitudinal opening extending through the valve housing; and the piston includes a metallic annular bevel on a second end portion adapted to seal against an annular non-metallic, non-elastomeric seat within a second end portion of the cylinder.

13. A subsurface safety valve comprising:

a tubular valve housing;

a valve closure member movable between an open and a closed position;

an axially shiftable flow tube for opening the valve closure member;

a spring for biasing the flow tube to a closed position;

a piston and cylinder assembly to move the flow tube to an open position and with at least one non-metallic, non-elastomeric seal; and the piston includes a non-metallic, non-elastomeric first end portion adapted to seal against an annular metallic seat within a first end portion of the cylinder.

14. A subsurface safety valve of claim 13 wherein the non-metallic, non-elastomeric seal is formed from material selected from the group consisting of polyetherketone (PEK), polyetheretherketone (PEEK), polyetherketoneetherketoneketone (PEKEKK), polyamides, polyethylene terephthalates (PET), polysulphones, epoxies, polyesters, polyethers, polyketones, and polymerizable combinations thereof.

15. A subsurface safety valve comprising:

a tubular valve housing;

a valve closure member movable between an open and a closed position;

an axially shiftable flow tube for opening the valve closure member;

a spring for biasing the flow tube to a closed position;

a piston and cylinder assembly to move the flow tube to an open position; and the piston includes a metallic, annular bevel on a second end portion adapted to seal against an annular non-metallic, non-elastomeric seat within a second end portion of the cylinder.

* * * * *